United States Patent [19]

Tsiamis et al.

[11] Patent Number: 4,556,587

[45] Date of Patent: Dec. 3, 1985

[54] PROCESS FOR ELECTRO-MAGNETIC INTERFERENCE SHIELDING

[75] Inventors: Chris Tsiamis, New York; John E. McCaskie, No. Merrick, both of N.Y.

[73] Assignee: LeaRonal, Inc., Freeport, N.Y.

[21] Appl. No.: 563,015

[22] Filed: Dec. 19, 1983

Related U.S. Application Data

[62] Division of Ser. No. 510,377, Jun. 30, 1983.

[51] Int. Cl.[4] ..... C23C 3/02

[52] U.S. Cl. ..... 427/304; 427/305; 427/306; 427/307; 427/443.1

[58] Field of Search ..... 427/306, 307, 304, 443.1

[56] References Cited

U.S. PATENT DOCUMENTS

| | | | |
|---|---|---|---|
| 3,983,267 | 9/1976 | Norris | 427/304 |
| 4,201,825 | 5/1980 | Ebneth | 427/306 |
| 4,308,301 | 12/1981 | Huss | 427/307 |
| 4,336,028 | 6/1982 | Tonibe | 427/443.1 |

OTHER PUBLICATIONS

Pushpavanam et al., "Electroless Nickel-a Versatile Coating", Finishing Industries, vol.1, No. 6, pp. 48-52, Jun. 1977.

Hajda et al., "Comparison of Electroless Deposit for Electromagnetic Interference Shielding", Plating & Surface Finishing, pp. 42-44, Jul. 1983.

Adcock, "Electroless Plating for EMI Shielding", Plating & Surface Finishing, pp. 40, 41, Jul. 1983.

"RFI Shielding", Published by General Electric Co.

"EMI Shielding, What You Need to Know and Why", J. J. Regan, Feb., 1981.

ASTM Proposed Standard B.08.02.05, "Standard Practice for Preparation of Plastic Materials for Electroplating".

Udylite Data Sheet Entitled, "Facts about EMI".

J. E. McCaskie, C. Tsiamis, and H. Gerhardt, "Ronabond Vest for EMI/RFI Shielding", Oct. 1982.

*Primary Examiner*—John D. Smith

*Attorney, Agent, or Firm*—Pennie & Edmonds

[57] ABSTRACT

A process for metal plating plastic or elastomeric materials which produces a coating of high conductivity which does not reduce over time is disclosed in this application to provide electro-magnetic interference shielding for said materials. This process uses either a particular special plating bath containing stabilizer additions with any surface preparation technique, or a certain specific surface preparation technique along with the use of a standard plating bath or the special stabilized plating bath to obtain metal coatings with the desired properties.

13 Claims, No Drawings

PROCESS FOR ELECTRO-MAGNETIC INTERFERENCE SHIELDING

This is a division of application Ser. No. 510,377 filed June 30, 1983.

DESCRIPTION

1. Technical Field

The present invention relates to a process for providing plastic or elastomeric materials with the capability for shielding electro-magnetic interference by metal plating said materials. This process utilizes a prior art surface preparation technology along with a special plating bath or a novel surface preparation process with either a prior art plating bath or the special plating bath to impart the desired shielding characteristics to the base material. The deposited metal coatings provide excellent electrical conductivity and a high bond strength, both of which do not change over time and which contribute to the effectiveness of the EMI shielding.

Another aspect of the present invention relates to the EMI shielded plastic articles which are produced by this process.

2. Background Art

During the operation of electrical or electronic equipment, electric and magnetic fields are generated which can interfere with the operation of other electrical or electronic devices. This phenomenon is termed Electro-Magnetic Interference (EMI). In the past, this has not been a significant problem for two reasons: first, there were many less electrical devices than today, and, more importantly, most of these devices were constructed of metal enclosures which effectively shielded this interference.

Today, however, the use of electrical and electronic equipment is growing at a substantial rate, and equipment enclosures which have previously been constructed of metal or other effective shielding materials have now given way to various plastics and similar materials that cannot shield EMI. Plastics have gained acceptance due to their light weight, high strength to weight ratio, ease of fabrication, corrosion resistance, and consolidation of parts, all of which contribute to the consumer appeal and lower cost of these electronic devices.

EMI is a wave which travels in a similar manner to light. When encountering construction materials, these waves can be reflected, absorbed, or transmitted depending upon the electrical properties (particularly the electrical conductivity) of the material. As mentioned above, metals are effective for EMI shielding because they have high electrical conductivities and absorb the EMI waves. On the other hand, plastics are insulators, and they allow these EMI waves to pass unimpeded through their structure.

The EMI waves that are generated by electrical or electronic equipement are comprised of two components. The electric field (E) component can penetrate any plastic or non-metallic material, but are absorbed by grounded metals or other materials having high electrical conductivity. The magnetic field (H) can penetrate all plastics and metals, but loses its effectiveness fairly rapidly as a function of distance from the source. In contrast, the electric fields are capable of creating interference over much greater distances.

The two components of electromagnetic waves propagate at right angles to the plane containing them. The relative magnitude of these fields are a function of distance between the generating source and receiver. The ratio of E to H is defined as the wave impedence, Zw. A low Zw occurs when the source contains a low voltage and high current. This situation is called a current source, magnetic source, or low impedance source, and a typical example is a transformer. Conversely, a high voltage with small current flow results in a high impedance, and the resultant field is primarily electrical.

When an EMI wave encounters a material, the wave will reflect if its impedance and that of the material substantially differ, and minimal energy will be transmitted across the boundary. The principle behind EMI shielding is to use a shielding material of low impedance, such as highly conductive metals, to reflect EMI waves. Magnetic waves have low impedance similar to metals, so that energy is transferred through the metal with minimal reflection. Consequently, the magnetic component of EMI waves can be difficult to shield, although, with distance, their effect significantly decreases. Since the electric component becomes the greater source of problems at farther distances, low impedance materials are used.

EMI waves pass through free space at $3\times10^8$M/sec and through other non-conductors such as plastic at essentially the same speed. When one places a conductive barrier to shield EMI, those waves strike the barrier and some of the energy is reflected back similar to light reflected from a mirror. Energy entering the conductive shield generates eddy currents in the conductor, further attenuating the wave's strength.

At higher frequencies, reflection decreases and absorption increases, and as a result, the reflected wave and the absorbed wave increase in materials of higher conductivity. As the reflected wave is independent of thickness, the relative thickness of the shielding has little effect on the reflected wave while the absorbed wave is strongly dependent on the shield thickness and thus its related attenuation level increases with the thickness of the barrier form.

The effectiveness of a shield is determined by measuring the separate field strength of a unit with and without a shield. The effectiveness of a shield is measured in decibels (db) as the ratio of field intensities before and after shielding. Measurements of Shielding Effectiveness (S.E.) can be of the electrical field (E), magnetic field (H), or power (P) as defined by one of the following equations:

$$S.E. = 20 \log E_b/E_a \text{ (Volts/meter)}$$

$$S.E. = 20 \log H_b/H_a \text{ (Amps/meter)}$$

$$S.E. = 10 \log P_b/P_a \text{ (Watts/square meter)}$$

Where:

$E_b$ = the electric field strength before the shield is installed;

$E_a$ = the electric field strength after the shield is installed;

$H_b$ = the magnetic field strength before the shield is installed;

$H_a$ = the magnetic field strength after the shield is installed;

$P_b$ = the power of the field before the shield is installed;

$P_a$ = the power of the field after the shield is installed.

Each 10 dB increment of attentuation or dissipation equates to a ten fold improvement in shielding effectiveness. A 10 dB attenuation means the signal strength reaching the sensor was reduced to 10% of source energy, 20 dB to 1% of source, etc. Typical values for shielding quality are shown below in Table I.:

TABLE 1

SHIELD QUALITY

| dB attenuation | Comments |
|---|---|
| 0–10 dB | Very little shielding |
| 10–30 dB | Minimal shielding |
| 30–60 dB | Average |
| 60–90 dB | Above average |
| 90–120 dB | Maximum to beyond existing state of art. |

It is estimated that an attenuation of at least 45 dB is required to provide adequate shielding for the electric or electronic equipment that is currently available today.

The degree of shielding effectiveness is not a constant for each shielding material, but is affected by the frequency of the incoming signal.

The shielding effectiveness is also determied by:

(a) The electrical conductivity of the shield.

(b) The thickness, uniformity, and smoothness of the shield.

(c) The physical properties of the shield.

(d) The frequency and impedance of the impinging field.

(e) The magnetic permeability of the material.

The electrical resistivity of the shielding material, measured in units of ohms/square (ohms/square is a non-dimensional measurement and does not refer to square inches or square feet) varies with the different materials used, and with the thickness.

The frequency spectrum affected by EMI has traditionally been defined as the radio frequency range of 10 KiloHertz to 100 Gigahertz. As mentioned above, metals provide excellent shielding properties while plastics do not, but plastics are preferred for construction of electrical device enclosures for the reasons given previously. Therefore, the prior art has attempted a number of different methods for coating plastics with metals. Each type of shielding material has its own degree of effectiveness. The needs of the application dictate, for the most part, which type metal coating is needed to provide the proper protection. A description of the more successful systems follows.

Pressure Sensitive Foils

A common approach is sticking self-adhesive copper, nickel, or aluminum foil on the interior of a cabinet. Tape or foil has excellent conductivity, but it has disadvantages in that it is a labor intensive process, and it is difficult to apply evenly to complex parts.

Vacuum Metallizing

Parts first receive a base coat, then are placed in a vacuum chamber, where a heated wire of aluminum, silver, copper, or another highly-conductive metal is vaporized and condensed on the plastic surface. The conductivity is generally proportional to the type and thickness of metallic film deposited. Problems with this process include special equipment requiring a significant capital investment and high operator skill levels, relatively expensive process materials, and the inability to obtain a consistent coating thickness on complex shapes or in restricted areas.

Flame and/or Arc Spray Process

Molten metal is deposited directly onto the surface requiring shielding. The metal used is generally pure zinc, copper, or aluminum. A hard, dense coating which exhibits a coarse textured finish is obtained, but conductivity is good over a wide frequency range. While these are versatile processes, they do require both specialized equipment and a high operator skill level, and additional problems relate to the generation of toxic fumes and possible part distortion from excessive heat when spraying.

Cathode Sputtering

A gas plasma discharge between a cathode composed of the metal to be plated and an anode which serves as both an electrode and a support for the plastic substrates. Positively charged gas ions accelerate into the cathode, dislodging metal atoms, which condense on the substrate to form a metal film having good conductivity. However, the electrical discharge increases substrate temperature which restricts the use of this process to the more highly heat-resistant plastic materials. This deposited shield is also susceptible to microscopic cracking, and expensive equipment requiring a high power supply is needed.

Silver Reduction

This is a wet, three step, silver plating process in which silver nitrate is reduced to elemental silver and precipitated onto the part. This technique utilizes hand spray guns and booths similar in design to those used by the spray painting industry. The metal coated part will exhibit excellent conductivity, perhaps the best shield per coating thickness of any product. While equipment cost is modest and operator skill level minimal, raw material costs are quite high due to the price of silver.

Metallic Paints

Silver, copper, nickel, and graphite are most often used with silver being the most common. Conductive paints are usually sprayed directly onto the molded part with conventional spray equipment and thus involving minimal capital investment. A high loading of metallic particles in the paint composition provides the necessary conductivity. While the conductivity for silver paints is very high, the cost of the coating is a significant factor. Copper paints are less expensive but require a heavier coating (than silver) to achieve desired shielding. Copper systems pose problems regarding oxidation (which eliminates conductivity) and sedimentation on the copper (which causes an adhesion problem). Nickel compositions are basically an inexpensive one coat process utilizing standard paint equipment. The nickel films produce good conductivity and good adhesion, but they do not provide uniform shielding. Furthermore, nickel tends to oxidize and change conductivity as a function of time and is suspected of being a possible carcinogen. Graphite is low-priced, stable and not susceptible to most environmental conditions. Graphite shields are not very effective and their use is limited to electrostatic discharging. It is also important to be sure that the paint vehicle is compatible with the plastic substrate.

Conductive Plastics

The one shielding method that does not require any secondary processing operations is to mold the part itself of a compound or composite containing conductive additives, such as carbon fibers, metal flakes or filaments, or metallized glass fibers. Problems associated with this approach include nonuniform additive dispersion, improper fiber or filament orientation, and resin-rich flange areas, which can result in inconsistent shielding as well as termination problems in the flange areas. Additionally, there is the relatively high cost of conductive additives, particularly if they are dispersed throughout the part, rather than localized in a thin layer, as with surface coatings.

Electroplating

This shielding method has been more prominent lately. Decorative finishes in a variety of metals which have excellent electrical parameters and shielding can be provided. A properly applied electrodeposit over a metallized plastic substrate is strongly adherent and resistant to chipping, but an expert knowledge of electroplating along with high processing equipment costs are required. Also, electroplating is difficult for certain plastics and configurations.

Electroless Plating

It is also without the electrodeposited layer alone to avoid the limitations of non-compatability with certain plastics or non-uniform coverage on parts having certain configurations, such as, for example, deep sidewalls.

In order to provide an electroless metal plated coating, the plastic or elastomeric part must be properly prepared. This preparation process consists of etching the surface of the plastic or elastomeric material, activating the etched surface by providing a metal nuclei catalyst thereon, and then plating the desired metal coating onto the metal nuclei catalyst. Prior art processes have used solutions containing chromium trioxide of a halogenated sulfonic acid, or atmospheres containing gaseous sulfur trioxide or a halogenated sulfonic acid in the etching step. The older prior art utilized a two step ionic noble metal catalyst for activating the surfaces of the plastic or elastomeric materials, but a new method for an improved activation step utilizes colloidal metal catalysts, as described in applicants' copending U.S. patent application entitled PROCESS FOR PLATING ON PLASTICS, filed of even date herewith. After this step, the activated material is then immersed into the electroless metal plating bath to deposit the desired metal.

For people skilled in the art, it would appear to be a simple matter to plate an electroless nickel or copper coating onto a plastic substrate and have it serve as a means of EMI shielding. Surprisingly, however, this is not the case. The degree of EMI shielding depends upon a number of factors in the process of producing a metallic film, including the degree of surface preparation on the plastic part, and the particular electroless plating bath itself.

It has been discovered that merely depositing a metal plating onto the plastic or elastomeric substrate by the older prior art electroless plating processes will provide a metal coating that is initially very high in electrical conductivity (and low in surface resistivity), but as time passes the conductivity drops (resistivity rises) and the metal coating becomes ineffective as a shielding material.

Shielding is measured and specified in terms of the reduction in field strength caused by the shield, as described previously. In addition to measurement of actual shielding attenuation, measurements of surface resistivity give an indication of relative performance of the plated metal coatings.

While the correlation between surface resistivity and shielding attenuation can vary depending upon the thickness and type or types of electroless plating, it is generally recognized that any conductive coating having a surface resistivity of less than 2 ohms/square (approximately 45–52 dB attenuation at 1000 megahertz) will offer satisfactory shielding to EMI. It is preferable for the surface resistivity to be less than about 1 ohm/square. Another important factor is that the surface resistivity must remain constant over a long period of time.

Surface resistivity is expressed in ohms/square, and is measured using two electrodes spaced an equal distance apart. As long as the length equals the width and the coating thickness is constant over the square area, the resistance is the same for any square. Standard test procedures are outlined and can be referred to in ASTM-D257. Testing for surface resistivity is most important to assure that the proper values for EMI shielding have been achieved.

Adhesion of the metallized coating to substrate is also of importance. For example, if the coating loses integrity or adhesion as a result of thermal cycling encountered during operations, it is possible for the conductive metal coating to come into contact with system components, possibly causing a short circuit or other malfunction.

A common method for evaluation of the adhesion of a coating is a cross hatch tape test according to ASTM D-3359. This adhesion test should be conducted after application of the coating and after any thermal or humidity aging treatments.

Shield selection is inherently difficult as it involves a compromise. Considerations include the source and type of EMI which is to be shielded, the source of EMI as to its emanating form, whether the EMI characteristics are primarily composed of magnetic and/or electrical fields, the expected environment the unit is to be operating within, and the permissible level of attenuation required for operation of the equipment.

The present invention resolves the limitations of the metal coating or plating processes of the prior art discussed above in that the resultant electroless metal coatings have a high conductivity (and low resistivity) that does not vary over time, so that an improvement in EMI shielding resistance is provided.

DESCRIPTION OF THE INVENTION

It is one object of the present invention to provide a process for the EMI shielding of non-metallic materials which can utilize either a prior art surface preparation technology along with a special plating bath or a novel surface preparation process with either a prior art plating bath or the special plating bath to enable the treated material to accept a uniform and strongly adherent electrolessly metal coating having a long term retention of high electrical conductivity (low resistivity).

A further object is to provide EMI shielded plastic or elastomeric articles which are coated with a uniform metal coating that is highly conductive and strongly adherent to the base material and which has a long term retention of high electrical conductivity.

Other objects of the present invention and advantageous features thereof will become apparent as the description proceeds.

This shielding process basically comprises the use of a surface preparation treatment for the substrate followed by a plating bath to achieve uniform, strongly adherent metal coatings that have high electrical conductivity and excellent shielding characteristics.

A surface preparation treatment for non-metallic substrates can include the well known prior art chromium trioxide or halogenated sulfonic acid solutions, or the use of liquid or gaseous sulfonating agents as described in U.S. Pat. No. 4,039,714 to Roubal et al. When a solution of chromium trioxide or halogenated sulfonic acid is used, the material to be plated is immersed into the solution and the properties of the surface of that material are changed so as to create optimum conditions for the application of activating catalysts. When these gaseous etching agents are used, the exposure time is reduced considerably and the concentration of the etching agent can be varied within wide limits, thus making it more useful for a greater variety of substrates.

After this etching step, the etched material is neutralized or reduced and then can be activated for electroless plating with the special plating both containing the citrate and a thiocarbonyl stabilizer as herein after described, by treatment with any prior art activating processes whether they be ionic or colloidal metal processes. After activation, the part can be placed into the electroless metal plating bath to deposit the desired metal.

As mentioned above, any electroless plating process that can deposit metal coatings on plastics or elastomers is capable of providing a metal coating that will initially possess a very low surface resistivity, however, upon standing for a period of time, these coatings gain resistivity (i.e.—lose conductivity) such that they would not be useful for EMI shielding. Applicants have now discovered that when special plating baths containing certain stabilizers and concentrations of complexing agents, the resultant deposited metal coatings do not lose conductivity over time. The stabilizer additions which are suitable for the process of the present invention include these compounds, containing a thiocarbonyl group, and this would include thio-urea. The addition of these thiocarbonyl compounds to the nickel plating baths containing selected concentration of complexing agents results in the deposition of metal coatings which provide the proper degree of EMI shielding and do not lose their effectiveness over time regardless of the etch process used to initially treat the plastic. Combinations of these stabilizer compounds can also be used with similar improvements in the shielding effectiveness over time.

A citrate salt such as sodium or ammonia citrate in an amount ranging from about 25 to 60 g/l and preferably about 30 g/l to a plating bath is the preferred complexing agent. The synergistic effect of the complexing agents and compounds containing thiocarbonyl groups result in improved long term retention of high electrical conductivity for the metal plating so that more effective EMI shielding is provided. This is shown in Example 5.

A typical special plating bath that was found to perform advantageously in this process contained about 15–35 gr/l of $NiCl_2 \times 6H_2O$, about 20 to 60 gr/l $NH_4Cl$ and from about 20 to 40 g/l $NaH_2PO_2 \times H_2O$, and about 25–60 g/l of sodium citrate with the balance being water. The addition of thio-urea as a stabilizer in the range of up to about 10 mg/l, and preferably 1–2 mg/l improved the retention of a long term high conductivity property to the metal coating.

Applicants have also discovered that the use of an improved surface preparation or etching treatment eliminates the need for special plating baths and allows the use of ordinary prior art baths. This improved etching process is described in applicants' copending patent application entitled PROCESS FOR PLATING ON PLASTICS. Basically, this new etching treatment comprises a. exposing the plastic material to a gaseous etching agent atmosphere containing sulfur trioxide under controlled conditions, and
b. activating the treated surface by contacting the surface with an activating metal colloid catalyst.

The gaseous etching agent atmosphere can be at a concentration of between about 1 mg/l and 100% by volume in an inert gas. The exposure time for the plastic or elastomer material would be between about 0.5 second and 20 minutes at a temperature sufficient to etch the surface of said material without substantially affecting its other physical properties.

Another advantage relates to the tolerance of a colloidal metal to humidity or moisture in the treating gas without affecting the uniformity of the surface conditioning. A practical advantage of this is that ambient air of high humidity can be used in the gas etch step to improve the surface etch results for subsequent activation with a metal colloid actuator. The amount of water contained with the treating gas or gas carrier (air) is not critical so long as the amount is sufficient to improve the etching results. The amount of water present should not be too high so that sufficient $SO_3$ residual gas is left to properly etch the substrate. A relative humidity of between 10 to 90% has been found to be satisfactory.

Satisfactory operating temperatures for this process can range from ambient to 275 F., although it is preferably carried out at about 100–150 F.

One of the key inventive features to the improved results of this process is the use of colloidal metals to activate the surface of the plastic or elastomeric material. The prior art processes utilized either one or two-step ionic noble metal catalysts in the activation step. For improved results, a sensitizing treatment of immersing the material to be plated into an acidified solution of stannous chloride was performed prior to activation. In the early stages of development of these processes, however, the prior art taught that colloidal nobel metals such as colloidal palladium should not be used with gaseous phase sulfonation if a good quality electroplated coating was to be obtained on a plastic or elastomeric substrate. Surprisingly, in the present invention, the use of colloidal metals for activating surfaces treated with gaseous sulfonation compounds or similar atmospheres achieves certain benefits over the prior art. For example, when using colloidal metals, the degree of etch on the plastic can be varied over a much wider range compared with the very narrow requirements of etching that is needed when using an ionic catalyst.

A further advantage when using colloidal catalysts also relates to the conditioning time. Whereas the prior art teaches that prolonged treatments provide poor bond strengths, the present invention finds the opposite; that the bond strength of the plated coating is improved with prolonged treatments of set conditions of gas concentration, temperature, etc. A prolonged treatment for ABS reson, for example, would be 70 seconds at 10 mole percent $SO_3$ and 140 seconds at 8.5 mole percent $SO_3$.

The etch reaction can thus be regulated or controlled to accept a uniform deposits of colloidal catalysts by regulating the $SO_3$ concentration, time of reaction, temperature, humidity conditions, and terminating the reaction in the treating chamber by treatment with ammonia, for example. Terminating the reactions in the treating chamber is particularly advantageous when using high mole percent $SO_3$ concentrations. The regulation and control of the etching step is, in essence, empirical and will vary depending on the plastic being employed. The degree of etch can be determined by routine experimentation for any plastic that will react with $SO_3$. One manner of determining the degree of etch is by physical observation. The plastic subjected to the etch is generally thin. When properly etched, the surface is dull or roughened.

Regarding the types of metal colloid catalysts that are useful in the activation step of the process of the present invention, the noble metals in colloid form provide the best results. This would include colloids of palladium, platinum, silver, gold, as well as other known noble metals. It has also been found, however, that the less expensive, more common, transition metal colloid catalysts also provide satisfactory results. This category would include copper, nickel, cobalt, and iron. Also, metal oxide or metal halide colloids can be used, as can combinations of any of these metal, metal oxide, or metal halide colloids. The colloidal metals, whether they be elemental, oxides, halides, or mixtures thereof should have a sufficient low valence to cause activation of the plastic surface for subsequent electroless deposition. These colloidal metal solutions are well known in the art and have been used commercially for many years. If the metal colloidal solution is an oxide of high valence state, reduction of the oxide colloid after deposition on the plastic surface may be necessary to achieve activation.

The metal colloids can be used in a one step or two step process and plastic parts are immersed into a solution of a metal colloid in a conventional manner. Generally, the solution is maintained at about 70 to 140 F. and preferably at about 80–100 F., and the parts are immersed for about 0.5 to 10 and preferably 1–3 minutes.

In another aspect of this process, a one or two step conditioner treatment is used after the gas etch treatment but before the activation step to improve the degree of surface activation by the metal colloids.

The two step conditioner treatment consists of a first step where the material to be plated is immersed into a non-ionic surfactant conditioner solution following the gas etch, and a second step, whereby the conditioned plastic material is rinsed in an alkaline solution of a pH 9 or above. The use of this conditioning treatment permits a greater proportion of the metal colloid to be absorbed onto the plastic surface than would otherwise occur. The greater the metal colloid included on the surface of the etched plastic, the easier it is to initiate the metal plating.

The one step conditioner treatment consists of a solution comprising a suitable non-ionic surfactant in an alkaline cleaner described previously. In preparation, it is preferred to add the surface active agent to the alkaline or acid solution. The alkaline solution can be the same as that described below with respect to the two step conditioner treatment. In case of the one step conditioning the pH can range between about 1 and 12. The preferred alkalis to be used is trisodium phosphate and sodium carbonate. Hydrochloric acid is the preferred acid.

These suitable surfactants include any non-ionic surfactants alone or in combination in a concentration of from about 0.1 to about 1 weight percent, and preferably about 0.2 weight percent. The temperatures and immersion times would be the same as for the alkaline cleaner step. The use of the conditioners permits additional advantages such as a broader operating range of etch, a broader list of permissible plastics that can be treated with good results, better adhesion to the plastic surface, and other similar improvements.

The conditioner treatment (one or two step) promotes absorption of the catalyst by interacting in some manner with the surface of the etched plastic. The present invention utilizes non-ionic polyoxyalkylenes or alkyl phenol polyoxyalkylene adduct solutions, such as polyoxyethylenated polyoxypropylene glycols and polyoxyethylenated alkylphenol. Polyoxyethylene glycol is preferred. The non-ionic sufactants can be used alone or in combination with each other. Amphoteric surfactants can also be used in combination with the non-ionic surfactants. Aryl containing surfactants are best utilized with the one step conditioner treatment, alkyl phenol ethoxalates are preferred. A conditioner concentration of from about 0.1 to 10 weight percent in a solvent of deionized water can be used and 1 weight percent is preferred. The conditioner solution temperature can range between 70 and 160 F. and is typically about 100 to 130 F. The part to be conditioned is immersed into this bath for a period of 0.5 to 10 minutes and preferably about 1–2 minutes.

The alkaline cleaning solution used to rinse the parts after exposure to the conditioner solution has a pH of about 9 or above, preferrably 11. Commercially available alkalis such as sodium or potassium hydroxide, sodium or potassium carbonate, trisodium phosphate or the like can be used. A solution temperature range of between 70 and 200 F. can be used with 125 to 145 F. being preferred. Parts are immersed between 0.5 to 10 minutes, and preferably 2 to 5 minutes.

After cleaning, with or without the use of a conditioner, a neutralizer dip is used to remove any residual alkali from the surface of the plastic parts. The neutralizers used are typically acid, such as 10 to 30% hydrochloric, and they can also include complexing or reducing agents if desired. Processing conditions can include a bath temperature of from 70 to 170 F., preferably 100–120 F., and an immersion time of 0.5 to 5 minutes, preferably 1–2 minutes. When the one step conditioner employs acid, neutralization is not necessary. However, some acid dip is advantageous to insure removal of the excess surfactant from the surface.

The activation step of the process of the current invention utilizes the conventional and known metal colloids described above, and is a surprising improvement over the one or two step ionic catalysts of the prior art.

The accelerator step that follows activation removes any stannous chloride or stannous hydroxide from the part surface by treatment in a dilute solution of acid or acid salt as is well known in the art. Typically, a 10% by weight hydrochloric acid solution is used, but chloride or fluoride salts, and chlorinated or fluorinated compounds can be added to increase the effectiveness of the acceleration process. Usually, this solution is maintained between 70 and 165 F. and preferably at about 110–120 F. It sometimes is agitated with air, and parts are immersed from 0.5 to 5 minutes and preferably about 1 minute.

When the surface is prepared using this new process, an electroless metal plating can be deposited either by standard prior art plating baths or the special plating baths described above. In this regard, however, the special plating baths are optional and not required as they are when the older prior art etching and activation steps are used. It should be noted that any standard prior art plating bath will provide some degree of shielding in this application, although it is especially advantageous to use electroless nickel plating baths which are capable of depositing a high purity nickel coating. Electroless nickel baths that produce coatings with a high phosphorus content usually have a higher resistivity which results in a less effective EMI shielding.

Also, the use of a conditioner step following the gas etch and preceding the alkaline rinse is optional. When it is used in conjunction with the improved etching and activation steps, the optimum surface preparation is obtained.

The process of the present invention is operable with any plastic or elastomeric material that will react with $SO_3$. Examples of these materials are given in U.S. Pat. No. 4,039,714 to Roubal, et al, and are expressly incorporated herein by reference.

The plastic or elastomeric substrate may contain conventional filler materials such as glass fibers, asbestos, other mineral fillers, sawdust, carbonaceous materials such as graphite, dyestuffs, pigments, etc.

The plastic carrier for the metal layer may be of different shape such as in the form of films, foils, molded articles, rods, fibers, foams, woven textile materials, or the like.

Also, the plated plastic articles of the present invention can be subsequently heat treated without adversely affecting the quality of the metal coating. In fact, heat treatments usually improve the bond strength of these coatings considerably as is well known.

Finally, the plated plastic or elastomeric articles produced by these metal plating processes are characterized by a uniform, dense metal coating that is strongly adherent having a very low surface resistivity that does not increase over time, thus making these articles suitable for EMI shielding.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

EXAMPLES

The scope of the invention is further described in connection with the following examples which are set forth for purposes of illustration only and are not to be construed as limiting the scope of the invention in any manner.

To demonstrate the effect of the electroless nickel bath composition on the shielding effectiveness of the resulting Ni/P deposit, the following tests were conducted.

Test panels of a flame retardant ABS material (product KJW of Borg-Warner) were etched for 2 minutes with a mixture of 1 mole percent $SO_3$ in dry air in a reaction vessel under atmospheric pressure and ambient air humidity conditions. The parts were subsequently neutralized with gaseous ammonia and were then removed from the reaction vessel, rinsed and processed through the following activation steps:

| | |
|---|---|
| (1) Alkaline cleaner (Sodium carbonate and trisodium phosphate pH = 11) | 3 minutes at 130 F. |
| (2) Water Rinse | |
| (3) Neutralizer dip (3% hydrochloric acid) | |
| (4) Colloidal Pd/Sn Catalyst (palladium catalyst = 40 ppm) | 3 minutes at 100 F. |
| (5) Water Rinse | |
| (6) Acid Accelerator (10% hydrochloric acid) | 1 minute at 115 F. |
| (7) Water Rinse | |

The alkaline cleaner, neutralizer, activation, and accelerator steps are described in the specification. The activated parts were then electroless plated for 30 minutes in electroless nickel baths of various compositions as shown in Table I.

The surface resistivity of the resulting deposits was measured upon drying (Ri), within 7 days of plating (Rw) and within 30 days of plating (Rf). The results are outlined in TABLE I.

EXAMPLE 1

Example 1 shows a bath formulation with no stabilizers. The surface resistivity, although very low initially, upon standing increases to values higher than 1,000 ohms/square within a week.

TABLE 1

| | EXAMPLE | | | | | |
|---|---|---|---|---|---|---|
| | 1 | 2 | 3 | 4 | 5 | 6 |
| $NiCl_2X6H_2O$ (g/l) | 25 | 25 | 25 | 25 | 25 | 25 |
| $NH_4Cl$ (g/l) | 30 | 30 | 30 | 30 | 30 | 30 |
| $C_6H_5Na_3O_7X2H_2O$ (g/l) | 15 | 15 | 15 | 30 | 30 | 30 |
| $NaH_2PO_2XH_2O$ (g/l) | 30 | 30 | 30 | 30 | 30 | 30 |
| 3-mercapto pyrimidine (mg/l) | — | 1 | — | 1 | — | — |
| thio-urea (mg/l) | — | — | 1 | — | 1 | — |
| pH (with $NH_4OH$) | 8.8 | 8.8 | 8.8 | 8.8 | 8.8 | 8.8 |
| Temperature (F.) | 110 | 90 | 90 | 110 | 110 | 110 |
| Time (minutes) | 30 | 30 | 30 | 30 | 30 | 30 |
| Ri (ohms/square) | 0.2 | 2 | 1.8 | 0.4 | 0.3 | 0.3 |
| Rw (ohms/square) | $10^3$ | 10–25 | 7–10 | 10–30 | 0.4 | $10^3$ |
| Rf (ohms/square) | $10^3$ | $10^3$ | $10^3$ | 50–200 | 0.4 | $10^3$ |

EXAMPLES 2 AND 3

Examples 2 and 3 show bath formulations similar to the bath of Example 1 but, in addition, they contain sulfur compound stabilizers 3-mercapto pyridine and thio-urea, respectively. It can be seen that the increase in the surface resistivity within 7 days of plating, for the parts processed in the baths, is appreciably smaller compared to that of the part that was processed in the bath that contained no stabilizer (Example 1). However, within 30 days the resistivity exceeds 1,000 ohms/square as in Example 1.

EXAMPLE 4

As in Example 2, a bath containing stabilizer A is used but, in addition, the sodium citrate complexant concentration was doubled. The increase in the surface resistivity after 7 days is comparable to that produced by the bath of Example 2, but after 30 days the surface resistivity of the deposit produced by this bath is smaller by a factor of about 10. Hence, an improvement occurs when the citrate complexant is used within the proper range.

EXAMPLE 5

A bath formulation similar to that of Example 4 is used, but thio-urea was substituted for 3-mercapto pyridine. It can be seen that there is only a slight increase in the surface resistivity of the test panel, even after 30 days. A synergetic effect of thio-urea and the citrate concentration is then obvious.

EXAMPLE 6

The synergetic effect, mentioned in Example 5, becomes more obvious in this example where the bath with the proper citrate concentration contains no thio urea. The surface resistivity in this example increases to more then 1,000 ohms/square within 7 days. Thus, it is seen that the proper bath formulation, as shown in Example 5 will produce deposits with stable surface resistivity characteristics. That, in turn, translates into an improved shielding performance. The relationship between shielding effectiveness (S.E.) and surface resistivity can be seen from Table II.

TABLE II

| R, ohms/square | S.E. db |
|---|---|
| 0.8–1.0 | 62 |
| 1.5–2 | 52 |
| 300–400 | 25 |
| $10^3$ | 6–13 |

Notes:
1. The test pieces consisted of fiber glass reinforced polyester materials of PREMIX, Inc. Ohio, they were coated with 60–70 microinches of electroless nickel on both sides.
2. The shielding effectiveness was measured at 1,000 MHz frequency in a shielded box test configuration.
3. These comparisons were determined on the basis of an electroless nickel coating. When other electroless metal coatings are provided, the surface resistivity may not directly correlate to the values obtained with nickel coatings so that the shielding effectiveness may not be equal for the same resistivities. However, since the shielding effectiveness can be easily determined for each plated article, routine testing can determine which resistivities correspond to an effective shielding level.

EXAMPLE 6

To demonstrate the effect of the degree of etch on the shielding effectiveness of plastics coated with a Ni/P electroless deposit, the following tests were conducted.

The workpieces in the example consisted of glass reinforced polyester material (SMC, product of PREMIX, INC.). They were etched and were neutralized under the following conditions:

Sample 1: 2 minutes in 2 mole percent $SO_3$ concentration and dry air conditions.

Sample 2: 5 minutes in 2 mole percent $SO_3$ concentration and ambient (humid) air condition (30% relative humidity).

Following etching and neutralization as in Example 1, the parts were processed through the following steps:

| | |
|---|---|
| (1) Water Rinse | |
| (2) Conditioner (1% Polyoxyethylene glycol) | 3 minutes at 70 F. |
| (3) Water Rinse | |
| (4) Alkaline Cleaner (sodium carbonate and trisodium phosphate, pH = 11) | 30 minutes at 90 F. |

-continued

| | |
|---|---|
| (5) Water Rinse | |
| (6) Neutralizer dip (30% Hydrochloric Acid) | |
| (7) Colloidal Pd/Sn Catalyst (palladium catalyst = 40 ppm) | 3 minutes at 100 F. |
| (8) Water Rinse | |
| (9) Acid Accelerator (10% Hydrochloric Acid) | 1 minutes at 115 F. |
| (10) Water Rinse | |
| (11) Electroless Nickel | 1 minute at 130 F. |

The steps involving the conditioner, alkaline cleaner, neutralizer, activation, and accelerator are described in the specification, while the electroless nickel bath was that of Example 2.

The surface resistivity was measured immediately after drying the plated specimens and it was measured again after 7 days. The results are listed in Table III.

TABLE III

| | Sample 1 | Sample 2 |
|---|---|---|
| etch time | 2 minutes | 5 minutes |
| Ri | 1–1.2 | 1.1.2 |
| Rf | $10^3$ | 1.2–1.5 |

EXAMPLE 7

Test panels of solid modified polyphenylene oxide (product N-190 of General Electric) were etched as follows:

Sample 1: 1½ minutes in 1 mole percent $SO_3$ and dry air.

Sample 2: 3½ minutes in 1 mole percent $SO_3$ and dry air.

The parts were then processed as per Example 6. The resistivity of the plated parts were measured after drying and, again, after 7 days.

TABLE IV

| | Sample 1 | Sample 2 |
|---|---|---|
| etch time | 1½ minutes | 3 minutes |
| Ri | 1 | 1 |
| Rf | $10^3$ | 1.2–1.4 |

Similiar observations were made with other types of plastics as well (polyurethane, flame retardant ABS, foam PPO, foam ABS, etc.)

It is apparent from these Examples that unless a properly formulated electroless nickel bath is used (such as that of Example 5), then the plastic substrate will have to be etched above a certain minimum level in order to produce deposits of stable surface resistivity and stable shielding characteristics. This etching level is specific for each type of plastic.

Having thus described our invention, what we claim as new and desire to secure by Letters Patent are:

1. A process for EMI Shielding of plastic or elastomeric materials which comprises:

(a) gas-etching the surface of said material by exposure to an atmosphere containing gaseous sulfur trioxide;

(b) controlling the gas-etching reaction to a point where the surface will accept a deposit of an activating colloidal metal;

(c) activating the etched surface by immersion into a solution containing a colloidal metal catalyst; and (d) plating the substrate with an electroless metal plating bath that contains an organic compound having a thiocarbonyl group in combination with a complexing agent capable of and in a sufficient amount to provide a metal coating which will provide a surface resistivity of less than about 1 ohm/-square both initially and after aging for at least one month.

2. The process according to claim 1 wherein said atmosphere contains a sufficient amount of water vapor to improve the adhesion and/or coverage of the etching.

3. The process according to claim 1 wherein said activating step comprises immersing the etched material into a solution containing a metal colloid.

4. The process according to claim 3 wherein said metal colloid is a noble metal colloid or a transition metal colloid.

5. The process according to claim 4 wherein said noble metal colloid is a colloid of palladium, platinum, silver, or gold.

6. The process according to claim 4 wherein said transition metal colloid is a colloid of copper, nickel, cobalt, or iron.

7. The process according to claim 1 which comprises (b) treating the etched surface with a conditioning agent comprising a non-ionic surfactant to improve the surface for activation with a catalytic metal colloid, (c) depositing said activating colloid from a colloidal metal solution, and (d) plating a metal coating upon the activated surface from an electroless metal bath.

8. The process according to claim 7 in which the surface is cleaned with an alkaline solution after conditioning.

9. The process according to claim 8 in which the conditioning agent contains the alkaline or acid cleaner.

10. The process according to claim 16 in which the surface is subsequently neutralized.

11. The process according to claim 9 in which the surface is subsequently treated with an acid.

12. The process according to claim 7 in which the surfactant is a polyoxyalkylene or an adduct thereof or an alkyl phenol ethoxalate.

13. The process according to claim 1 wherein the electroless metal plating is nickel.

* * * * *

UNITED STATES PATENT AND TRADEMARK OFFICE

CERTIFICATE OF CORRECTION

PATENT NO. : 4,556,587

DATED : December 3, 1985

INVENTOR(S) : Chris Tsiamis and John E. McCaskie

It is certified that error appears in the above-identified patent and that said Letters Patent is hereby corrected as shown below:

Column 16, line 18, "claim 16" should be --claim 8--.

Signed and Sealed this

*Twentieth* Day of *May 1986*

[SEAL]

*Attest:*

DONALD J. QUIGG

*Attesting Officer*

*Commissioner of Patents and Trademarks*